US006443568B1

(12) United States Patent
Askeland et al.

(10) Patent No.: US 6,443,568 B1
(45) Date of Patent: Sep. 3, 2002

(54) PRINTING STRATEGY FOR IMPROVED IMAGE QUALITY AND DURABILITY

(75) Inventors: Ronald A. Askeland; Ronald J. Burns; Paul J. Bruinsma, all of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/895,428

(22) Filed: Jun. 29, 2001

(51) Int. Cl.[7] ..... B41J 2/17; B41J 2/01
(52) U.S. Cl. ..... 347/98; 347/100; 347/101
(58) Field of Search ..... 347/96, 98, 101, 347/100

(56) References Cited

U.S. PATENT DOCUMENTS 4,694,302 A 9/1987 Hackleman et al. ..... 346/1.1
5,549,740 A 8/1996 Takahashi et al. ..... 106/20 R
5,624,484 A 4/1997 Takahashi et al. ..... 106/31.75
5,640,187 A 6/1997 Kashiwazaki et al. ..... 347/101
5,746,818 A 5/1998 Yatake ..... 106/31.86
6,092,890 A * 7/2000 Wen et al. ..... 347/101
6,203,146 B1 3/2001 Palowski, Jr. et al. ..... 347/85
6,238,045 B1 * 5/2001 Ono et al. ..... 347/100

FOREIGN PATENT DOCUMENTS

EP 0726158 A1 * 8/1996 ..... B41J/2/21

* cited by examiner

*Primary Examiner*—John Barlow
*Assistant Examiner*—Manish S. Shah
(74) *Attorney, Agent, or Firm*—W. Bradley Haymond

(57) ABSTRACT

Underprinting and/or overprinting clear fixer liquid onto an inkjet printed image, giving time for underprinted fixer to partially dry before depositing the inkjet printed image and/or giving time for the inkjet printed image to dry before overprinting the clear fixer liquid.

31 Claims, 3 Drawing Sheets

PRINTING STRATEGY FOR IMPROVED IMAGE QUALITY AND DURABILITY

BACKGROUND OF THE INVENTION

Inks used in inkjet recording are commonly composed of water-soluble organic solvents (humectants, etc.), surfactants, and colorants in a predominantly aqueous fluid. When a recording is made on "plain paper", the deposited colorants retain some mobility, which can be manifest in bleed, poor edge acuity, feathering, and inferior optical density/chroma (due to penetration of the paper). These features adversely impact text and image quality. Furthermore, when aqueous inkjet ink is printed on media designed for offset printing, problems arise because of the low absorbency of the offset media.

The evaporation rate of water-based inks is low and they dry primarily by the absorption into paper. The absorption time of an ink is dependent on many factors, such as the ink drop size, paper pore size, ink viscosity, and the ink spreading coefficient over the paper (that is, the surface tension of the paper minus the surface tension of inks and the interfacial tension of the paper-ink interface). There is a considerable interest in reducing the ink drying time, in particular, for high throughput printers. However, shortening the drying time is normally attained at the expense of the image quality. Thus, adding surfactants to inks can significantly reduce the penetration time. This however decreases the optical density/chroma and the edge acuity of the image, as well as ultimately leading to strikethrough problems, because of the penetration of the colorants in normal and lateral directions of the paper.

To address these problems, methods have been developed in which a "fixer" solution, with components to reduce colorant mobility, is deposited on the paper prior to depositing the ink. This "under-printing" of imaging ink uses compositions containing acids, salts, and organic counter ions and polyelectrolytes. Underprinting is defined as applying a transparent liquid on paper just before applying inks. The idea is to apply "a separate reactive component" before the inks in order to improve waterfastness. The "reactive component" reacts with the colorant present in the inks, producing an insoluble reactant-colorant complex and makes the printed image waterfast.

Underprinted fixer solutions have been used to improve aqueous inkjet ink color saturation, edge acuity and durability of inkjet printed images.

In other disclosures, the underprinting idea has been further developed. For example, using a cationic "liquid composition" such as a polyallylamine for underprinting of anionic dyes has been used to achieve a fixer which reacts broadly with dye based systems as a whole.

A broad class of underprinting liquids for polymer dispersed pigments has also been disclosed, including polymer latexes, silica, alumina and titanium oxide particles, polymer resins, buffer solutions, and inorganic salts. All these underprinting liquids destabilize the pigment dispersions by various mechanisms. As a result, the pigment substantially precipitates at the surface of the paper, while the vehicle is quickly absorbed.

Another system has been described that uses water-soluble dyes and an underprinting fixer. The fixer contains ligand-complexed metal ions (metal ion with an associated ligand). The ink used in this system contains an anionic component, which may be the dye itself. The ink may also contain a polymeric viscosity modifier. The specific polymeric viscosity modifier can be an ethylene oxide adduct of acetylene glycol—a neutral polymer which unlike the present invention does not interact strongly with the fixer.

SUMMARY OF THE INVENTION

In one embodiment, the present invention relates to an ink-jet printing apparatus, comprising:

at least one printhead portion including a fixer fluid comprising a colorant precipitating component selected from at least one of the group consisting of cationic polymer, cationic multivalent metal salts and cationic surfactant, and at least one printhead portion including an inkjet ink comprising a colorant selected from the group consisting of anionic dyes and anionic pigments;

wherein, before the inkjet ink is printed onto a zone of a medium, a layer of the fixer fluid is underprinted and at least partially dried onto the zone to be inkjet printed, and after the inkjet ink is printed onto the zone, a fixer fluid is overprinted and at least partially dried onto the zone.

In another embodiment, the invention relates to an underprinting fixer fluid comprising a colorant precipitating component selected from at least one of the group consisting of cationic polymer, cationic multivalent metal salts and cationic surfactant, wherein, after a layer of the underprinting fixer fluid is applied onto a zone to be inkjet printed on a medium and before inkjet printing an image onto the zone, the layer of underprinting fixer fluid is at least partially dried.

In yet another embodiment, the present invention relates to an overprinting fixer fluid comprising a colorant precipitating component selected from at least one of the group consisting of cationic polymer, cationic multivalent metal salts and cationic surfactant, wherein, after inkjet printing an image onto a zone of the medium, a layer of the overprinting fixer fluid is applied onto the zone and the layer of the overprinting fixer fluid is at least partially dried.

In still another embodiment, the present invention relates to an inkjet ink comprising a colorant selected from the group consisting of anionic dyes and anionic pigments;

wherein, before the inkjet ink is printed onto a zone of a medium, a layer of an underprinting fixer fluid is applied and at least partially dried onto the zone to be inkjet printed, the underprinting fixer fluid comprising a colorant precipitating component selected from at least one of the group consisting of cationic polymer and cationic surfactant, and after the inkjet ink is printed onto the zone, an overprinting fixer fluid is applied and at least partially dried onto the zone, the overprinting fixer fluid comprising a colorant precipitating component selected from at least one of the group consisting of cationic polymer, cationic multivalent metal salts and cationic surfactant.

In again another embodiment, the present invention relates to a method of ink-jet printing, the method comprising the steps of:

a) applying a layer of an underprinting fixer fluid onto a zone to be inkjet printed on a medium, the underprinting fixer fluid comprising a colorant precipitating component selected from at least one of the group consisting of cationic polymer, cationic multivalent metal salts and cationic surfactant;

b) at least partially drying the layer of underprinting fixer fluid;

c) inkjet printing an image onto the dried layer of underprinting fixer fluid on the zone;

d) at least partially drying the inkjet printed image;

e) applying a layer of an overprinting fixer fluid over the zone on the medium, the overprinting fixer fluid comprising a colorant precipitating component selected from at least one of the group consisting of cationic polymer, cationic multivalent metal salts and cationic surfactant; and f) at least partially drying the layer of overprinting fixer fluid.

DETAILED DESCRIPTION OF THE PREFERRED EMBODIMENT

Previous uses of fixer solutions in inkjet printing have not taken into account the effects of time delay and penetration depth of the fixer. With the development of page wide array inkjet printing systems, such effects on fixer effectiveness have needed to be further analyzed.

A clear fixer liquid underprinted before the inkjet ink image is printed on the medium can improve color saturation and uniformity. This is achieved when the cationic polymer, cationic multivalent metal salts and/or cationic surfactant in the fixer precipitates anionic dyes or anionic pigments in the inkjet ink either on or in the media. Without such underprinted fixer, problems result with either absorbant or non-absorbant media. For example, when the slightly glossy media designed for offset printing is used, colors wash off because of the slow absorbance quality of the media.

On the other hand, with "plain paper" non-glossy media, the ink penetrates readily into the media, causing problems with color uniformity.

A clear fixer with cationic polymer, cationic multivalent metal salts and/or surfactant can also be overprinted onto inkjet printed images. Such an overprinted fixer adds durability. Inkjet printed images without such an overprinted fixer give poor results in water drip and wet smudge tests. Problems result however when inkjet ink color is applied immediately after fixer is underprinted while the fixer is still wet. Ink/fixer precipitates can form little bumps or hills on top of the media. These bumps of precipitate are susceptible to mechanical abrasion. The present inventors have found in experiments that such bumps do not usually form when there is at least a 0.1 to two second break between the application of the underprint fixer and the application of the inkjet ink. Furthermore, if the printzone is heated during the time between underprinting the fixer and printing the ink, the inkjet/fixer precipitates are even less likely to form bumps. The effect of the heat is analogous to adding more time between the underprinting of the fixer and the printing of the ink. Furthermore, the best color uniformity is achieved when there is enough underprinted fixer to fully cover the printzone.

Figure 1:
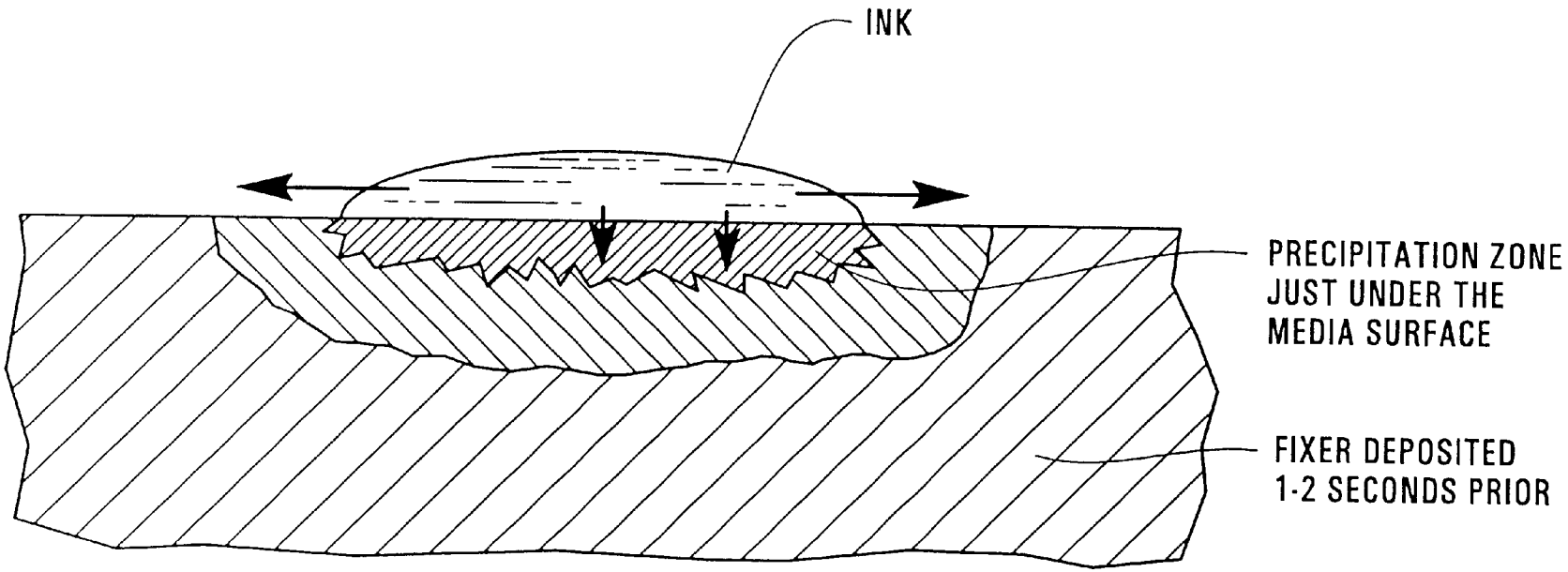
FIG. 1 shows a cross section of a media surface. The ink drop appears upon the surface of the medium. The precipitation zone is located just below the ink drop. Below and surrounding the precipitation zone is absorbed fixer unprecipitated with the ink.

Providing a delay time between the application of underprinting fixer and ink allows the fixer drops to spread and penetrate into the media surface. The ink applied after the delay precipitates with the fixer only as the ink penetrates into the media. Therefore ink applied on top of the media after a suitable delay can spread and penetrate into the media surface (see FIG. 1). With the precipitation reaction between the fixer and ink occurring only within the top surface of the media (especially with offset media which only absorbs liquid slowly), the ink colorant is less prone to mechanical abrasion. In contrast, when ink is applied on the underprinted fixer without a delay time, ink and fixer react on top of the media surface, because the colorant does not have a chance to spread or penetrate into the media.

Based on experiments conducted with inkjet inks designed to print on offset media, one preferred process of applying fixer and ink is as follows:

(a) Print fixer;

(b) Apply time and heat for approximately 0.1–2 seconds;

(c) Print Color lnkjet Ink (preferably as multipass or multiarrays) to reduce bleed/coalescence;

(d) Apply time and heat for approximately 0.1–2 seconds;

(e) Print fixer.

In one preferred embodiment of the present invention, the fixer, either underprinted or overprinted, is clear and transparent to the eye when printed on paper. However, in another preferred embodiment, fluorescent marker dyes that absorb in either the ultraviolet and emit in the visible or absorb in the visible and emit in near infrared may be present in the fixer to provide a way to check for nozzles out in the fixer pen.

Figure 3:
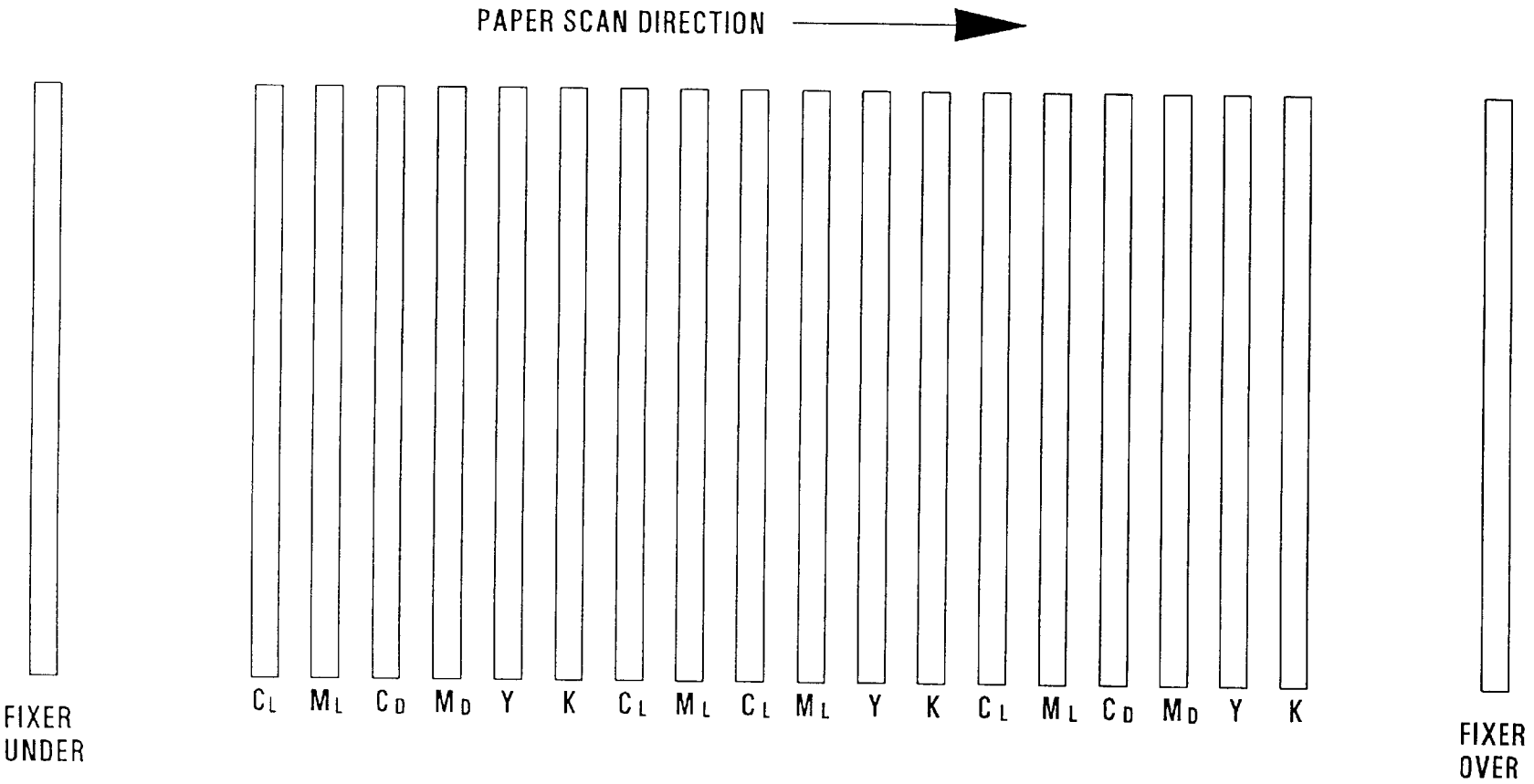
FIG. 3 shows a diagram of the pen array layout for a page wide printer incorporating the invention.

In one embodiment of the present invention, the printer which incorporates the present invention is a page wide array printer. FIG. 3 shows a diagram of the inkjet pen array layout for a page wide array printer incorporating this invention. The diagram shows the array of inkjet ink pens positioned closely together, with the underprinting fixer pen preceding the array of ink pens and spaced away from it and the overprint fixer pen following the array of ink pens and also spaced away from it.

EXAMPLE

Printing Heated Offset Media

One pass of fixer undercoat, then two passes of inkjet printed ink, then one pass of fixer overcoat were applied to a specific area of heated offset media over a period of 3 seconds to simulate the conditions of the page wide array printing process. The cumulative density of the ink on the media was measured at short intervals during that period and further to 6 seconds. Both the fixer undercoat and overcoat were applied at a density of 30 pl/300 dpi pixel of fixer (which is approximately 30 grams of fixer for passes 1 and 4). First cyan, then magenta were applied during each of ink passes 2 and 3 from separate pens. Both cyan and magenta ink were applied at a density of 22.5 pl/300 dpi/pass (which is approximately 45 grams/pass). The liquid evaporated from the printed area at a roughly constant rate of 0.20 fraction per second while the liquid ended up being absorbed into the media at a roughly constant rate of 0.10 fraction. Cumulative Ink Density is a measurement of the density of the ink initially laid down before evaporation or absorption takes place. Surface & Interior Ink Density is a measurement of the density of the ink on and in the media taking into account the effects of evaporation over specific time intervals (i.e., Surface & Ink Density=Cumulative−Evaporation). Surface Ink Density is a measurement of the density of the ink on the media taking into account the effects of both evaporation and absorption over specific time intervals (i.e., Surface Density=Cumulative−Evaporation−Absorption)

Data from the above experiment is collected in Table1, shown below:

TABLE 1

| | Ink Density (pl/300 dpi) | | | Mass loss (ng) | |
|---|---|---|---|---|---|
| Time (sec) | Cumulative | Surface & Interior | Surface | Evaporation (20%/sec) | Absorption (10%/sec) |
| 0 | 0 | 0.00 | 0.00 | | |
| 0.0001 | 30 | 30.00 | 30.00 | | |
| 1 | 30 | 24.00 | 21.60 | 6.00 | 2.40 |
| 1.0001 | 52.5 | 46.50 | 44.10 | | |
| 1.04 | 52.5 | 46.13 | 43.55 | 0.37 | 0.17 |
| 1.0401 | 75 | 68.63 | 66.05 | | |
| 2 | 75 | 55.45 | 47.80 | 13.18 | 5.08 |
| 2.0001 | 97.5 | 77.95 | 70.30 | | |
| 2.04 | 97.5 | 77.33 | 69.40 | 0.62 | 0.28 |
| 2.041 | 120 | 99.83 | 91.90 | | |
| 3 | 120 | 80.66 | 65.75 | 19.17 | 6.98 |
| 3.0001 | 150 | 110.66 | 95.75 | | |
| 4 | 150 | 88.53 | 66.26 | 22.13 | 7.36 |
| 5 | 150 | 70.82 | 43.69 | 17.71 | 4.85 |
| 6 | 150 | 56.66 | 26.58 | 14.16 | 2.95 |

Figure 2:
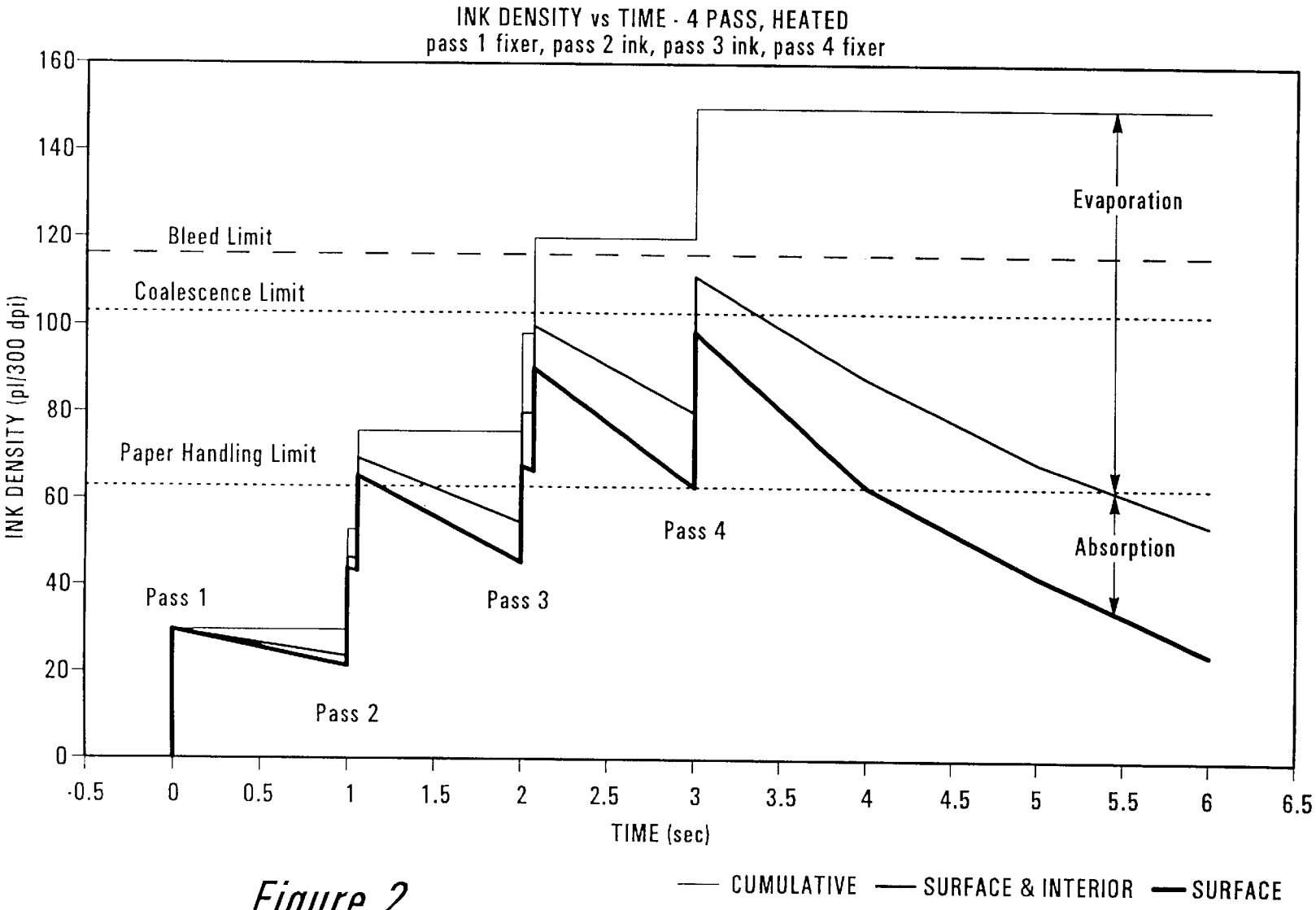
FIG. 2 plots ink density data vs. time to simulate the conditions of the page wide array printing process. Time is shown on the x-axis and ink density is shown on the y-axis.

FIG. 2 plots the data of Table 1, with time in seconds plotted on the x-axis and the ink density in picoliters/300 dpi plotted on the y-axis. Not only the two passes of inkjet printed ink are shown on the graph but also the pass of underprinted fixer occurring before the ink passes and the pass of overprinted fixer occurring after the ink passes.

By separating in time the underprinting of the fixer from the ink lay down and heating the underprinted fixer, there is time for the fixer to partially dry and absorption to take place before inkjet printed ink is applied.

Similarly, a wait time between the laydown of inkjet printing ink layer and application of overprinted fixer reduces the total liquid present on the surface and in the interior of the media.

Also shown on FIG. 2 are estimated ink density limits under the given conditions of ink type and media for paper handling (65 pl/300 dpi), bleed (115 pl/300 dpi) and coalescence (105 pl/300 dpi). In other words, it is estimated that: surface+interior ink density must be less than 65 pl/300 dpi in order to move the paper off the platen or belt; ink density must be less than 115 pl/300 dpi to avoid bleed; and surface ink density must be less than 105 pl/300 dpi to avoid coalescence.

What is claimed is:

1. An ink-jet printing apparatus comprising:

at least one printhead portion including a fixer fluid comprising a colorant precipitating component, and at least one printhead portion including an inkjet ink comprising a colorant;

wherein, before the inkjet ink is printed onto a zone of a medium, a layer of the fixer fluid is underprinted and at least partially dried onto the zone to be inkjet printed, and after the inkjet ink is printed onto the zone, the fixer fluid is overprinted and at least partially dried onto the zone;

and wherein there is a 0.1 to 2 second break between the underprinting of the fixer fluid layer and the printing of the inkjet ink onto the zone to allow the fixer fluid to partially dry;

and wherein there is a 0.1 to 2 second break between the inkjet printing of the image onto the zone of the medium and the overprinting of the fixer fluid layer onto the zone to allow the inkjet printed image to partially dry.

2. The apparatus of claim 1, wherein the colorant precipitating component is selected from at least one of the group consisting of cationic polymers, cationic multivalent metal salts and cationic surfactants; and the colorant is selected from the group consisting of anionic dyes and anionic pigments.

3. The apparatus of claim 1, wherein the colorant precipitating component is selected from at least one of the group consisting of anionic polymers, anionic multivalent metal salts and anionic surfactants; and the colorant is selected from the group consisting of cationic dyes and cationic pigments.

4. The apparatus of claim 1, wherein the fixer fluid further comprises a fluorescent marker dye.

5. The apparatus of claim 1, wherein the layer of underprinted fixer fluid, the inkjet printed image and the layer of overprinted fixer fluid are dried by heating the zone.

6. The apparatus of claim 1, wherein the layer of underprinted fixer fluid and the layer of overprinted fixer fluid completely cover the zone.

7. An underprinting fixer fluid comprising a colorant precipitating component;

wherein, after a layer of the underprinting fixer fluid is applied onto a zone to be inkjet printed on a medium and before inkjet printing an image onto the zone, the layer of underprinting fixer fluid is at least partially dried;

and wherein there is a 0.1 to 2 second break between the underprinting of the fixer fluid layer and the printing of the inkjet ink onto the zone to allow the fixer fluid to partially dry.

8. The underprinting fixer fluid of claim 7, wherein the layer of underprinting fixer fluid is dried by heating the zone.

9. The underprinting fixer fluid of claim 7, wherein the layer of underprinting fixer fluid completely covers the zone.

10. The underprinting fixer fluid of claim 7, wherein the colorant precipitating component is selected from at least one of the group consisting of cationic polymers, cationic multivalent metal salts and cationic surfactants; and wherein the zone is inkjet printed with an ink comprising a colorant selected from the group consisting of anionic dyes and anionic pigments.

11. The underprinting fixer fluid of claim 7, wherein the colorant precipitating component is selected from at least one of the group consisting of anionic polymers, anionic multivalent metal salts and anionic surfactants; and wherein the zone is inkjet printed with an ink comprising a colorant selected from the group consisting of cationic dyes and cationic pigments.

12. The underprinting fixer fluid of claim 7, wherein the underprinting fixer fluid further comprises a fluorescent marker dye.

13. An overprinting fixer fluid comprising a colorant precipitating component;

wherein, after inkjet printing an image onto a zone of the medium, a layer of the overprinting fixer fluid is applied onto the zone and the layer of overprinting fixer fluid is at least partially dried;

and wherein there is a 0.1 to 2 second break between the inkjet printing of the image onto the zone of the medium and the overprinting of the fixer fluid layer onto the zone to allow the inkjet printed image to partially dry.

14. The overprinting fixer fluid of claim 13, wherein the inkjet printed image and the layer of overprinting fixer fluid is dried by heating the zone.

15. The overprinting fixer fluid of claim 13, wherein the layer of overprinting fixer fluid completely covers the zone.

16. The overprinting fluid of claim 13, wherein the colorant precipitating component is selected from at least one of the group consisting of cationic polymers, cationic multivalent metal salts and cationic surfactants; and wherein the inkjet printing is conducted with an ink comprising a colorant selected from the group consisting of anionic dyes and anionic pigments.

17. The overprinting fluid of claim 13, wherein the colorant precipitating component is selected from at least one of the group consisting of anionic polymers, anionic multivalent metal salts and anionic surfactants; and wherein the inkjet printing is conducted with an ink comprising a colorant selected from the group consisting of cationic dyes and cationic pigments.

18. The overprinting fixer fluid of claim 13, wherein the overprinting fixer fluid further comprises a fluorescent marker dye.

19. An inkjet ink comprising a colorant wherein, before the inkjet ink is printed onto a zone of a medium, a layer of an underprinting fixer fluid is applied and at least partially dried onto the zone to be inkjet printed, the underprinting fixer fluid comprising a colorant precipitating component, and after the inkjet ink is printed onto the zone, an overprinting fixer fluid is applied and at least partially dried onto the zone, the overprinting fixer fluid comprising a colorant precipitating component;

and wherein there is a 0.1 to 2 second break between the underprinting of the fixer fluid layer and the printing of the inkjet ink onto the zone to allow the fixer fluid to partially dry;

and wherein there is a 0.1 to 2 second break between the inkjet printing of the image onto the zone of the medium and the overprinting of the fixer fluid layer onto the zone to allow the inkjet printed image to partially dry.

20. The inkjet ink of claim 19, wherein the layer of underprinting fixer fluid, the inkjet printed image and the layer of overprinting fixer fluid are dried by heating the zone.

21. The inkjet ink of claim 19, wherein the layer of underprinting fixer fluid and the layer of overprinting fixer fluid completely cover the zone.

22. The inkjet ink of claim 19, wherein the ink comprises a colorant selected from the group consisting of anionic dyes and anionic pigments; and the underprinting fixer fluid and the overprinting fixer fluid both comprise a colorant precipitating component selected from at least one of the group consisting of cationic polymers, cationic multivalent metal salts and cationic surfactants.

23. The inkjet ink of claim 19, wherein the ink comprises a colorant selected from the group consisting of cationic dyes and cationic pigments; and the underprinting fixer fluid and the overprinting fixer fluid both comprise a colorant precipitating component selected from at least one of the group consisting of anionic polymers, anionic multivalent metal salts and anionic surfactants.

24. The inkjet ink of claim 19, wherein both the underprinting fixer fluid and overprinting fixer fluid further comprise a fluorescent marker dye.

25. A method of ink-jet printing, the method comprising the steps of:

a) applying a layer of an underprinting fixer fluid onto a zone to be inkjet printed on a medium, the underprinting fixer fluid comprising a colorant precipitating component;

b) at least partially drying the layer of underprinting fixer fluid;

c) inkjet printing an image onto the dried layer of underprinting fixer fluid on the zone;

d) at least partially drying the inkjet printed image;

e) applying a layer of an overprinting fixer fluid over the zone on the medium, the overprinting fixer fluid comprising a colorant precipitating component; and f) at least partially drying the layer of overprinting fixer fluid;

wherein there is a 0.1 to 2 second break between the underprinting of the fixer fluid layer and the printing of the inkjet ink onto the zone to allow the fixer fluid to partially dry;

and wherein there is a 0.1 to 2 second break between the inkjet printing of the image onto the zone of the medium and the overprinting of the fixer fluid layer onto the zone to allow the inkjet printed image to partially dry.

26. The method of claim 25, wherein the drying steps are conducted by heating the zone.

27. The method of claim 25, wherein the layer of underprinting fixer fluid and the layer of overprinting fixer fluid completely cover the zone.

28. The method of claim 25, wherein the inkjet printing is conducted with an ink comprising a colorant selected from the group consisting of anionic dyes and anionic pigments and both the underprinting and overprinting fixer fluids comprise colorant precipitating components selected from at least one of the group consisting of cationic polymers, cationic multivalent metal salts and cationic surfactants.

29. The method of claim 28, wherein both the underprinting fixer fluid and overprinting fixer fluid further comprise a fluorescent marker dye.

30. The method of claim 25, wherein the inkjet printing is conducted with an ink comprising a colorant selected from the group consisting of cationic dyes and cationic pigments and the underprinting and overprinting fixer fluids comprise a colorant precipitating component selected from at least one of the group consisting of anionic polymers, anionic multivalent metal salts and anionic surfactants.

31. The method of claim 30, wherein both the underprinting fixer fluid and overprinting fixer fluid further comprise a fluorescent marker dye.

* * * * *